US011696637B2

(12) United States Patent
Lin

(10) Patent No.: US 11,696,637 B2
(45) Date of Patent: Jul. 11, 2023

(54) LEG STRUCTURE OF ELECTRIC TABLE

(71) Applicant: TIMOTION TECHNOLOGY CO., LTD., New Taipei (TW)

(72) Inventor: Yu-Chang Lin, New Taipei (TW)

(73) Assignee: TIMOTION TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 17/388,011

(22) Filed: Jul. 29, 2021

(65) Prior Publication Data

US 2022/0400846 A1 Dec. 22, 2022

(30) Foreign Application Priority Data

Jun. 22, 2021 (TW) ..... 110207219

(51) Int. Cl.
*A47B 9/04* (2006.01)
*A47B 9/20* (2006.01)

(52) U.S. Cl.
CPC ..... *A47B 9/04* (2013.01); *A47B 9/20* (2013.01); *A47B 2200/0057* (2013.01); *A47B 2200/0059* (2013.01)

(58) Field of Classification Search
CPC ..... A47B 9/04; A47B 9/20; A47B 2200/0057; A47B 2200/0059; A47B 2200/0011; A47B 2200/0012; A47B 2200/0013; A47B 2200/0014
USPC ..... 108/144.11, 155
See application file for complete search history.

(56) References Cited

U.S. PATENT DOCUMENTS 642,962 A * 2/1900 Danner ..... A47B 13/06 108/155
4,691,644 A * 9/1987 Frydman ..... A47B 47/03 312/265.5
4,896,778 A * 1/1990 Ferdinand ..... A47F 7/08 D6/672
5,088,421 A * 2/1992 Beckstead ..... A47B 9/12 248/406.1
5,142,996 A * 9/1992 Thorn ..... F16B 12/42 108/158
5,224,429 A * 7/1993 Borgman ..... A47B 17/033 248/188.4

(Continued)

FOREIGN PATENT DOCUMENTS

DE 202010014611 U1 * 3/2012 ..... A47B 13/088
KR 20160033374 A * 3/2016

*Primary Examiner* — Daniel J Troy
*Assistant Examiner* — Timothy M Ayres
(74) *Attorney, Agent, or Firm* — Chun-Ming Shih; HDLS IPR Services

(57) ABSTRACT

A leg structure of an electric table includes a pair of support assemblies (10), multiple horizontal rods (20) and a pair of drive assemblies (30). The support assemblies (10) are arranged spacedly and parallelly to each other. Each support assembly (10) includes a connecting rod (11) and a pair of telescopic posts (12). Each telescopic post (12) is connected and fixed to the connecting rod (11). Each horizontal rod (20) is separately connected to each support assembly (10) and is parallel to each other. Each drive assembly (30) is separately received in each support assembly (10) for driving each telescopic post (12) to ascend or descend. Therefore, the leg structure of an electric table may be easily assembled and the whole structure is stable.

12 Claims, 9 Drawing Sheets

(56) References Cited

U.S. PATENT DOCUMENTS

| | | | | |
|---|---|---|---|---|
| 5,458,429 | A * | 10/1995 | Shimoda | G10H 1/32 403/258 |
| 6,457,787 | B1 * | 10/2002 | Chicoyne | F16B 12/30 312/265.4 |
| 6,647,900 | B1 * | 11/2003 | Kopish | A47B 3/0815 108/115 |
| 6,926,613 | B1 * | 8/2005 | Binning | F16B 12/46 403/231 |
| 9,743,758 | B2 * | 8/2017 | Johnson | A47B 87/002 |
| 10,531,732 | B1 * | 1/2020 | Huang | F16B 7/14 |
| 10,555,602 | B1 * | 2/2020 | Lu | A47B 9/04 |
| 10,690,164 | B2 * | 6/2020 | Stapleton | F16B 12/16 |
| 10,758,039 | B2 * | 9/2020 | Allen | F16H 25/20 |
| 2013/0022394 | A1 * | 1/2013 | Yang | F16B 12/10 403/345 |
| 2017/0303679 | A1 * | 10/2017 | Tseng | A47B 9/04 |
| 2019/0211860 | A1 * | 7/2019 | Yang | F16B 12/48 |
| 2019/0374023 | A1 * | 12/2019 | Allen | A47B 9/20 |
| 2020/0046113 | A1 * | 2/2020 | Nourse | A47B 21/06 |
| 2020/0154876 | A1 * | 5/2020 | Liu | A47B 9/00 |

* cited by examiner

LEG STRUCTURE OF ELECTRIC TABLE

BACKGROUND

Technical Field

The disclosure relates to an electric table, particularly to a leg structure of an electric table.

Related Art

To satisfy different circumferences and demands, tables with different heights are required. Thus, many electric lift tables appear in the market. The desktop can be lifted or lowered by driving the lead screw structures in the legs to generate height variations.

However, an electric lift table includes a desktop, four telescopic posts and four support rods for supporting the desktop. Thus, when assembling, each telescopic post has to be individually connected to each support rod. That is time-consuming. In addition, production tolerance exists between each telescopic post and each support rod, and a margin also exists between a screw and a threaded hole when screwing. That makes the assembled table unstable. How to make a table easy to be assembled and stable after assembling is an issue to be solved.

In view of this, the inventors have devoted themselves to the above-mentioned related art, researched intensively and cooperated with the application of science to try to solve the above-mentioned problems. Finally, the disclosure which is reasonable and effective to overcome the above drawbacks is provided.

SUMMARY

An object of the disclosure is to make legs of an electric table easy to be assembled and make the whole structure be stable.

To accomplish the above object, the disclosure provides a leg structure of an electric table, which includes a pair of support assemblies, multiple horizontal rods and a pair of drive assemblies. The support assemblies are arranged spacedly and parallelly to each other. Each support assembly includes a connecting rod and a pair of telescopic posts. Each telescopic post is connected and fixed to the connecting rod. Each horizontal rod is separately connected to each support assembly and is parallel to each other. Each drive assembly is separately received in each support assembly for driving each telescopic post to ascend or descend.

The disclosure further has the following functions. In comparison with the structure of four main bodies and two control boxes, the structure of two main bodies and one control box of the disclosure may save the cost. By the locking block and connecting portion, the support assembly and horizontal rod may be rapidly assembled without shaking. By the pivot and the pivot hole, it is easy for the maintenance personnel to repair and organize wiring in the wiring tray. The plastic slant worm gear may effectively reduce noise and vibration when operating. The silencing pad disposed between the box and the main body may effectively reduce noise when the main body is in operation.

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
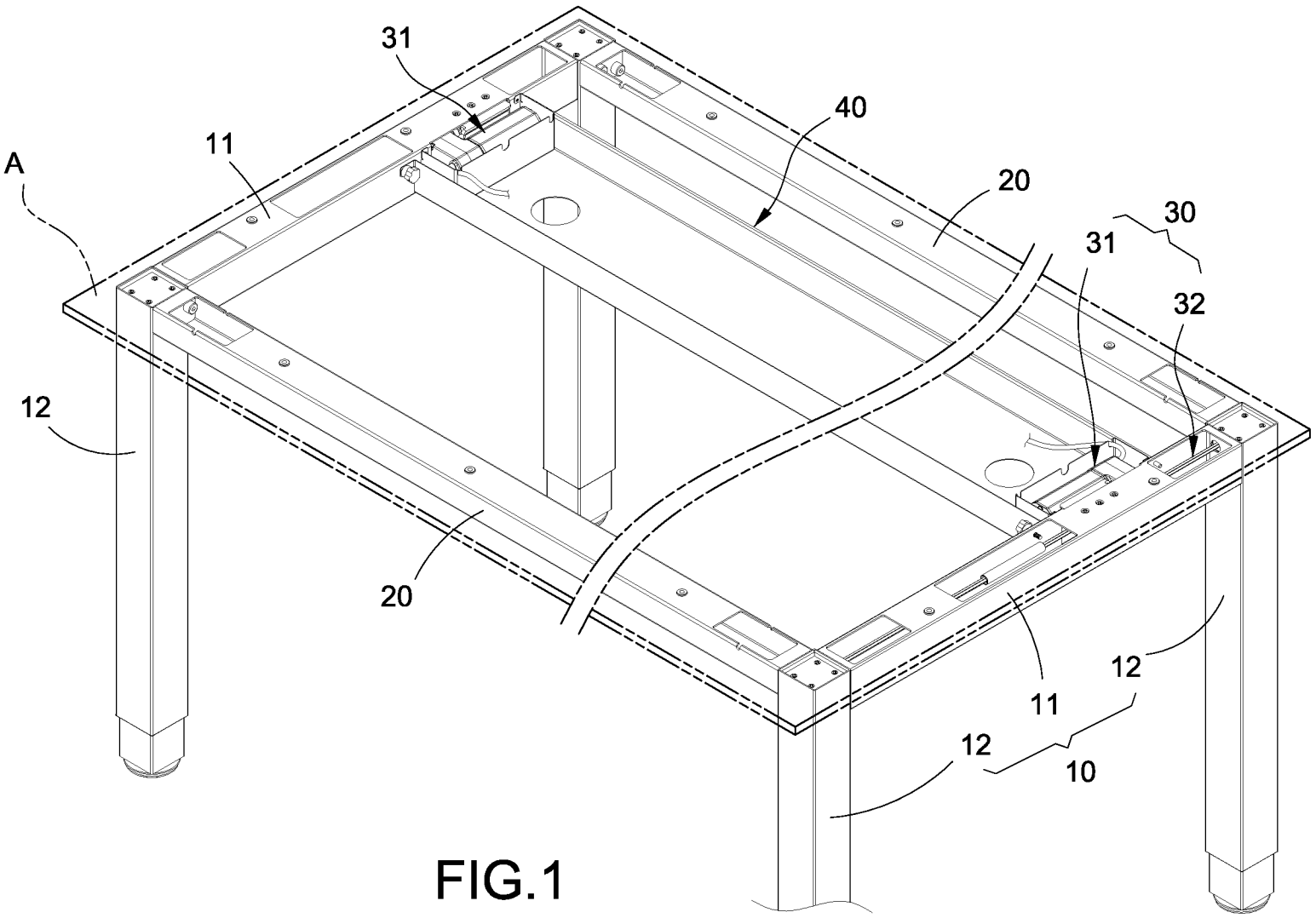
FIG. 1 is a perspective view of the disclosure.
Figure 2:
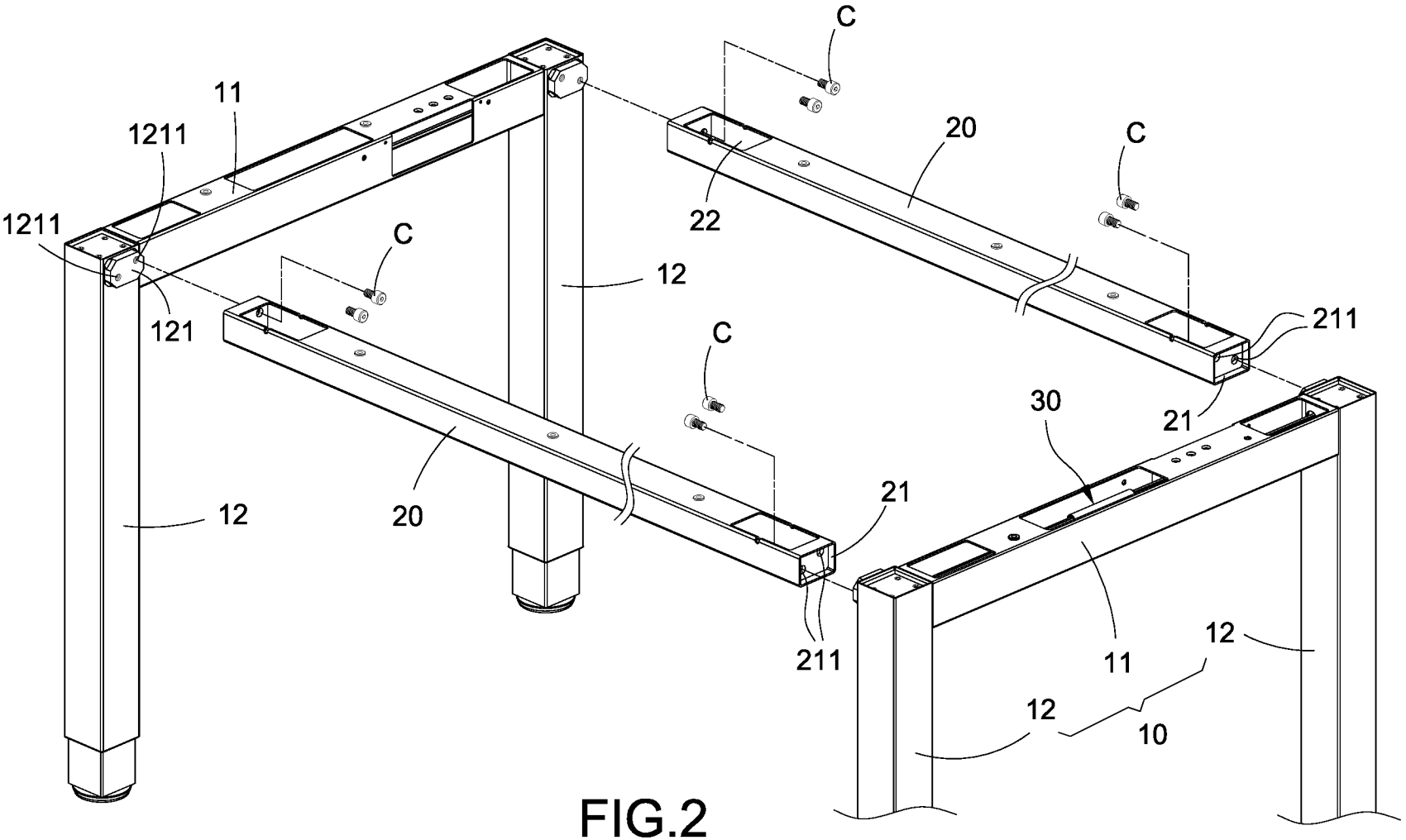
FIG. 2 is an exploded view of the disclosure.
Figure 3:
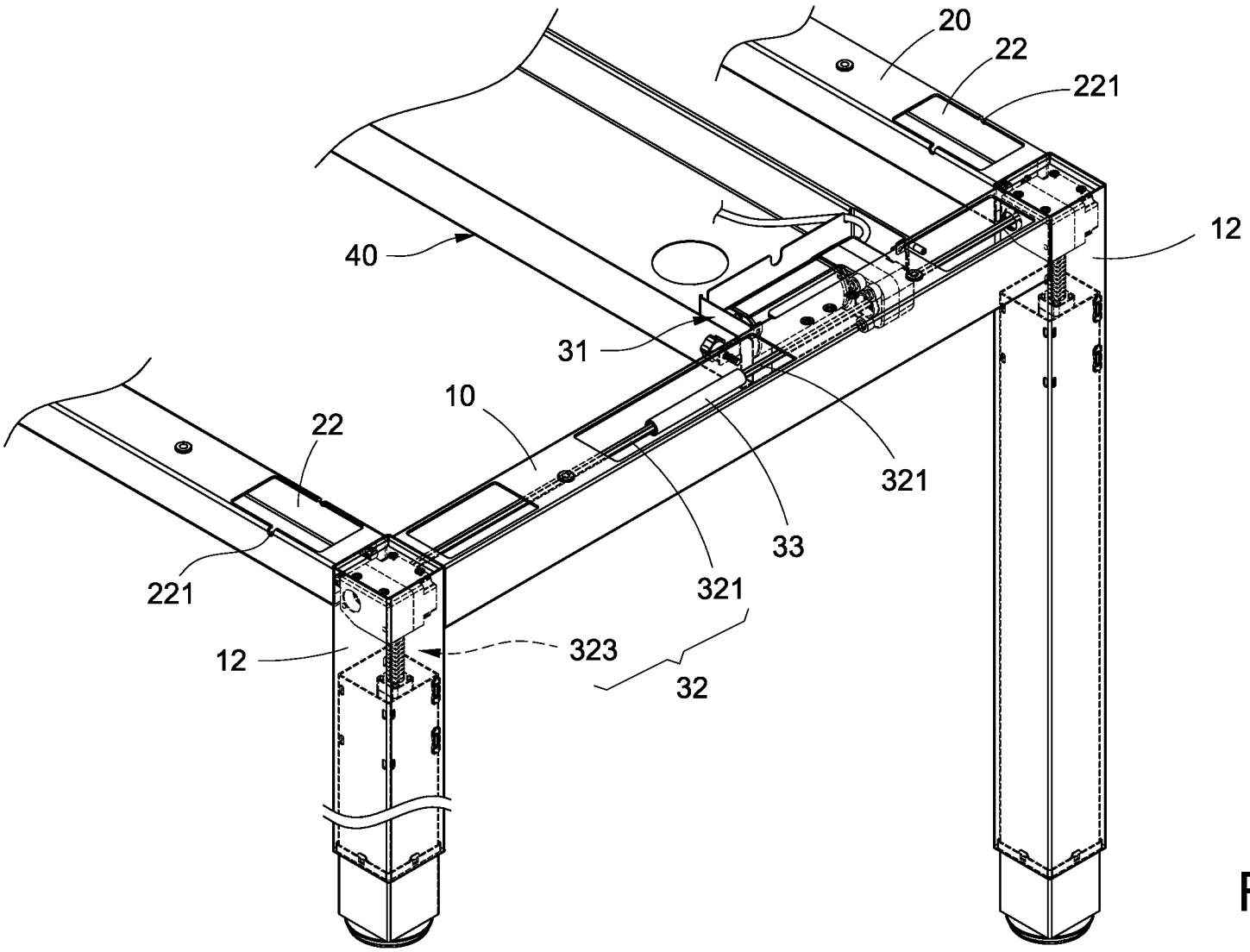
FIG. 3 is a partially perspective view of the disclosure.
Figure 4:
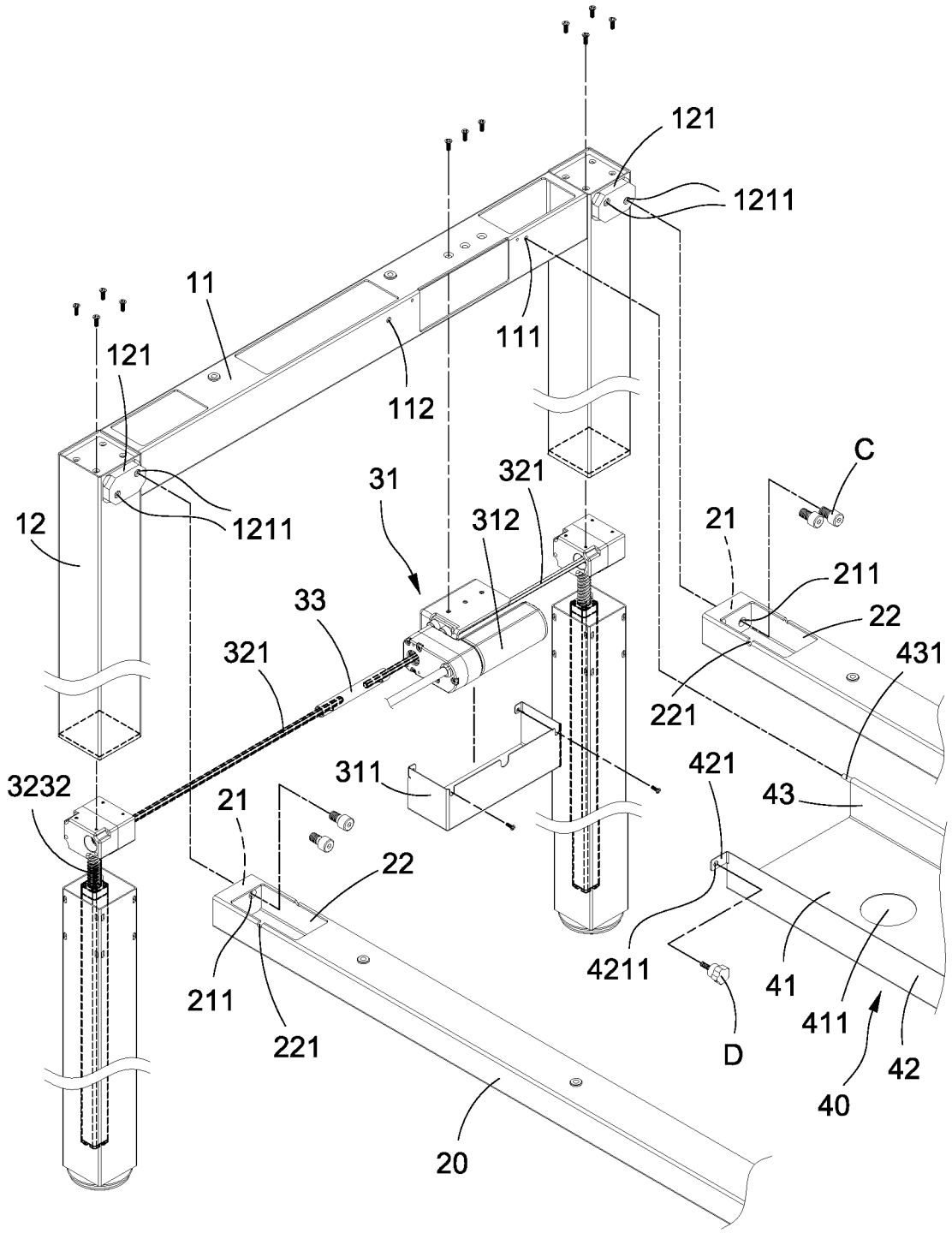
FIG. 4 is a partially exploded view of the disclosure.
Figure 5:
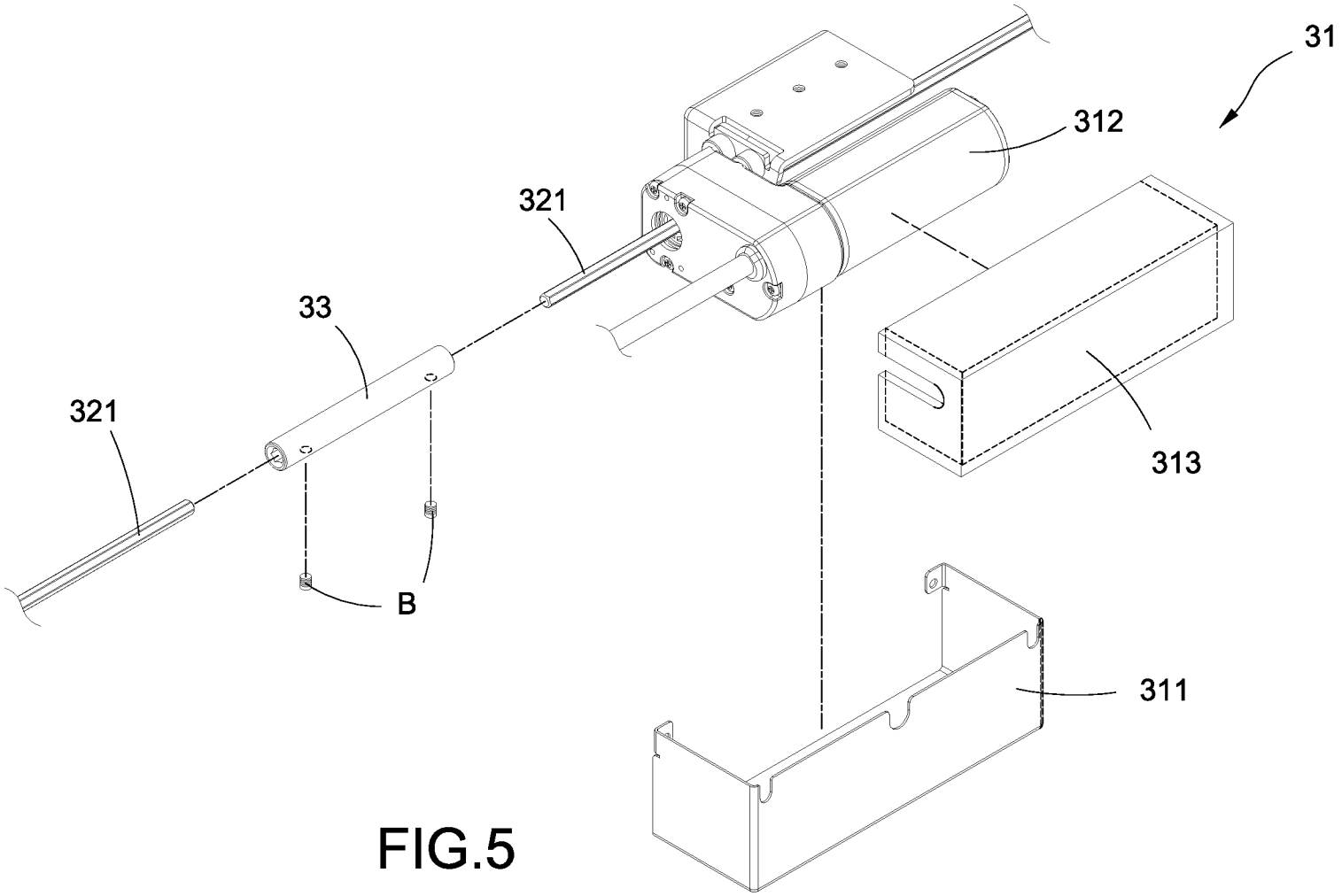
FIG. 5 is a partially exploded view of the driving assembly of the disclosure.
Figure 6:
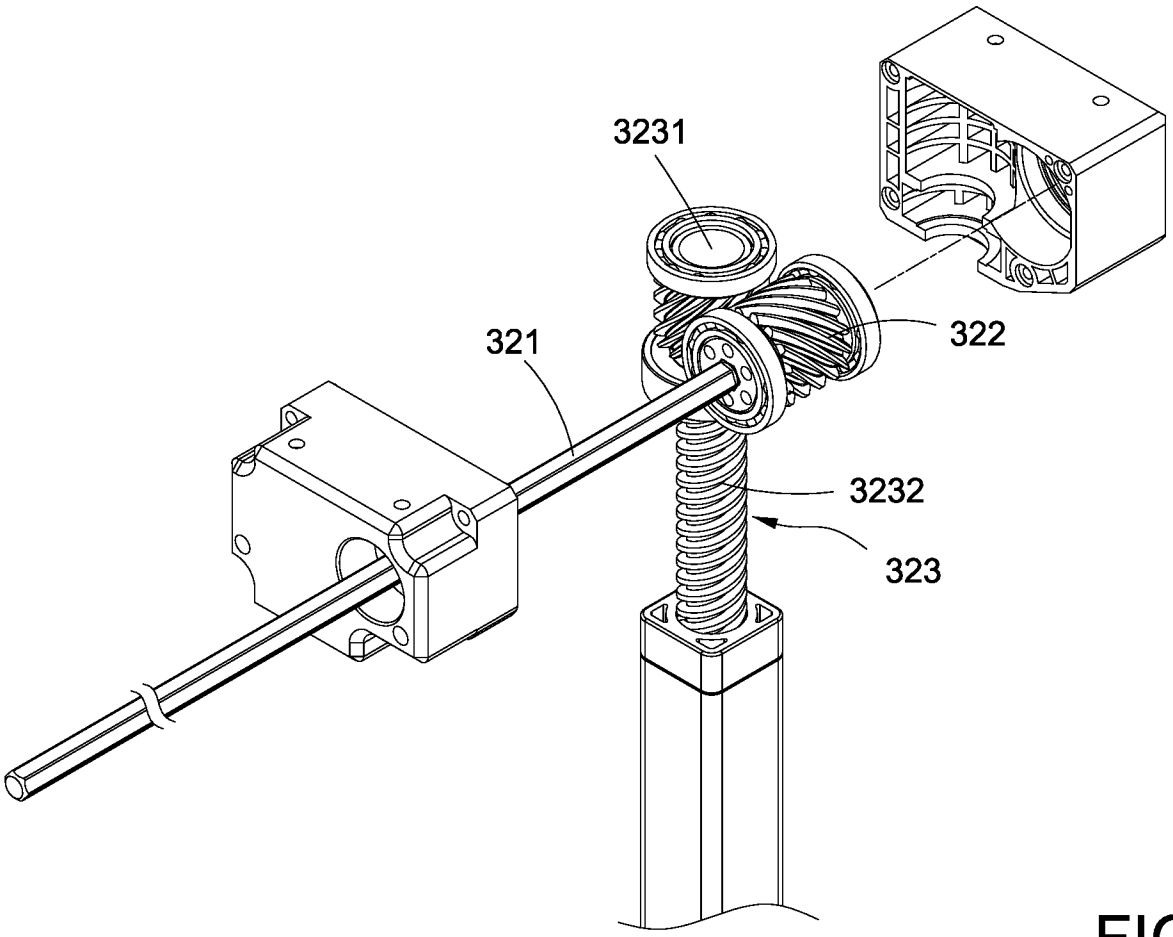
FIG. 6 is an exploded view of the transmission of the disclosure.

The disclosure provides a leg structure of an electric table for supporting a desktop A. Please refer to FIGS. 1-3. The leg structure of the electric table includes a pair of support assemblies 10, multiple horizontal rods 20 and a pair of drive assemblies 30.

In the embodiment, each support assembly 10 is formed by, but not limited to, a hollow square tube of carbon steel or alloy steel. For example, each support assembly 10 may also be a metal hollow tube or an alloy hollow tube with desired strength. An outline of the hollow tube may also be angular, circular or polygonal. The support assemblies 10 are arranged spacedly and parallelly to each other. Each support assembly 10 includes a connecting rod 11 and a pair of telescopic posts 12. The two telescopic post 12 are connected and fixed to two ends of the connecting rod 11, respectively. Each telescopic post 12 is perpendicular to the connecting rod 11 to configure the support assembly 10 in a U-shape. In the embodiment, the connecting rod 11 and each telescopic post 12 are connected by welding to make the connecting rod 11 and each telescopic post 12 be unremovable and unbendable. That improves the structural strength of the support assembly 10 and additional assembling process is not required for the user.

In the embodiment, each horizontal rod 20 is formed by, but not limited to, a hollow square tube of carbon steel or alloy steel. For example, each horizontal rod 20 may also be a metal hollow tube or an alloy hollow tube with desired strength. The horizontal rods 20 are separately connected to each support assembly 10 and are parallel to each other. In the embodiment, each horizontal rod 20 and each connecting rod 11 jointly constitute a loading surface for loading the desktop A. But the disclosure is not limited to this, for example, top of each horizontal rod 20 and top of each connecting rod 11 may be not identical in height or a rubber pad or a plastic pad is disposed on each horizontal rod 20 or each connecting rod 11 to load the desktop A, depending on requirements of designs or uses. In addition, the disclosure does not limit the length relationship between the connecting rod 11 and the horizontal rod 20, for example, the connecting rod 11 may be longer than, shorter than or equal to the horizontal rod 20 in length, depending on various requirements.

Please refer to FIGS. 3-6. Each drive assembly 30 is separately received in each support assembly 10 for driving each telescopic post 12 to ascend or descend. Each drive assembly 30 includes an electric motor 31 and two transmissions 32 disposed on two sides of the electric motor 31.

Each transmission 32 is arranged corresponding to one of the telescopic posts 12. In the embodiment, each electric motor 31 includes a box 311 and a main body 312 disposed in the box 311. The box 311 is disposed on an inner side of the connecting rod 11 without being exposed. In some embodiment, please refer to FIG. 5, the electric motor 31 further includes a silencing pad 313 disposed between the main body 312 and the box 311 for reducing noise when the main body 312 is in operation.

Please refer to FIGS. 3-6. Each transmission 32 includes a transmission shaft 321, a first gear 322 and a lead screw gear set 323. The lead screw gear set 323 includes a second gear 3231 and a lead screw 3232 connected to the second gear 3231. The lead screw 3232 is fixed in the corresponding telescopic post 12 to make the telescopic posts 12 be extended or collapsed by rotating the lead screw 3232.

In the embodiment, the drive assembly 30 further includes a drive rod 33. One of the transmission shafts 321 in the drive assembly 30 passes through the main body 312. An end of the transmission shaft 321 is sheathed by the drive rod 33 to be connected with the other transmission shaft 321. Two ends of the drive rod 33, which is adapted to sheathe the transmission shafts 321, may be separately tightened by a set screw B so that the main body 312 may simultaneously drive the two transmission shafts 321 to rotate. In some embodiments, a cross section of each transmission shaft 321 is, but not limited to, hexagonal. For example, a cross section of the transmission shaft 321 may also be quadrilateral or pentagonal. Also, other ends of the two transmission shafts 321 are separately connected to each first gear 322. Each first gear 322 separately engages with the second gears 3231 of corresponding two lead screw gear sets 323. In the embodiment, each of the first gear 322 and the second gear 3231 is a slant worm gear. When the main body 312 is rotated, the first gear 322 is driven to rotate though each transmission shaft 321 and the second gear 3231 of the lead screw gear set 323 rotates, so that the lead screw 3232 rotates to lift or lower the telescopic post 12. In the embodiment, the first gear 322 and the second gear 3231 are plastic members so as to reduce noise and vibration caused by the operation to improve the performance.

In detail, the junction of each telescopic post 12 and the horizontal rod 20 is protruded with a locking block 121. In detail, the locking block 121 is a polygonal block made of carbon steel or alloy steel. In some embodiments, the locking block is welded on each telescopic post 12, but not limited to this, for example, each locking block 121 may also be fixed on the telescopic post 12 by fastening or engaging. Two ends of each horizontal rod 20 are separately formed with a connecting portion 21 corresponding to each locking block 121 in shape so that each horizontal rod 20 may be positioned to the corresponding telescopic post 12 to avoid vibration. In some embodiments, each connecting portion 21 is formed with multiple fixing holes 211 and each locking block 121 is formed with multiple threaded holes 1211 so that each horizontal rod 20 may be fastened to each telescopic rod 12 by a screwing element C. Also, two ends of the top of each horizontal rod 20 are separately formed with an opening 22 corresponding to each connecting portion 21 in position, so that the opening 22 allows the screwing element C and a tool to be placed when each horizontal rod 20 is being fastened on each telescopic post 12.

Figure 7:
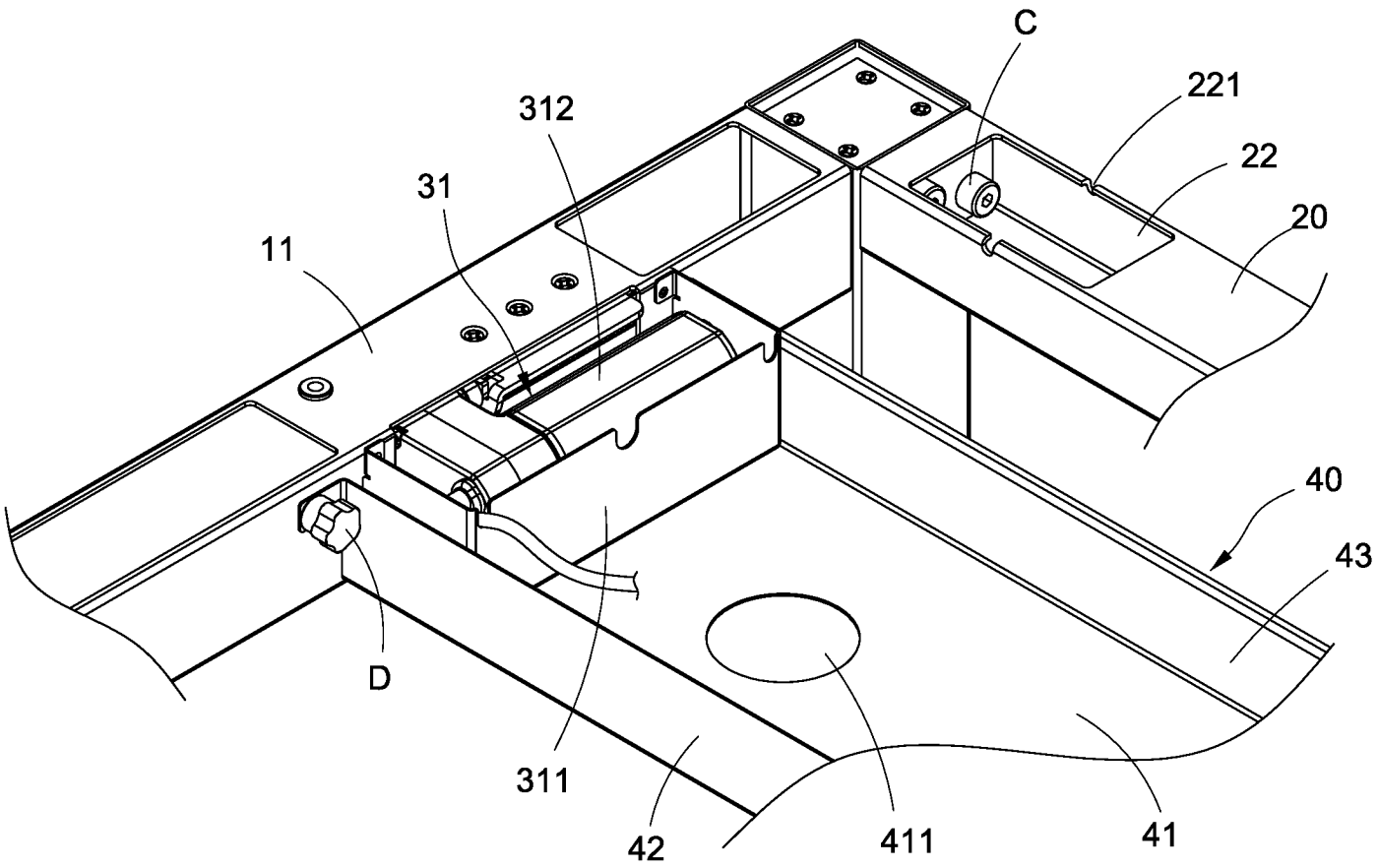
FIG. 7 is a partially perspective view of the wiring tray of the disclosure.
Figure 8:
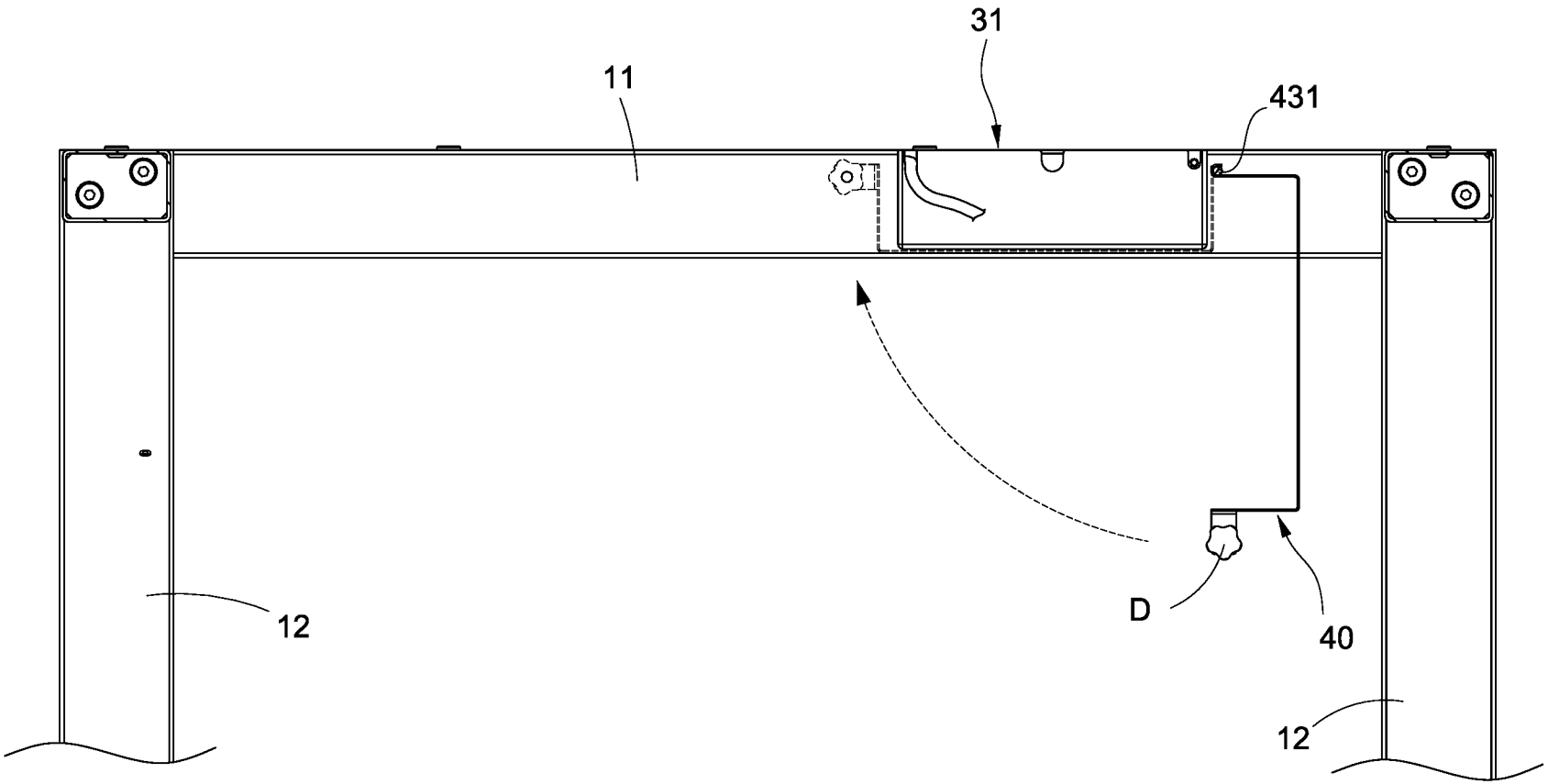
FIG. 8 is a schematic view of the wiring tray of the disclosure in use.

Please refer to FIGS. 1, 4, 7 and 8. The disclosure further includes a wiring tray 40. The wiring tray 40 is a long U-shaped box and has a bottom 41, a front wall 42 and a rear wall 43. The front wall 42 and the rear wall 43 are disposed on the front side and the rear side of the bottom 41. In the embodiment, a width of the wiring tray 40 is greater than a width of the electric motor 31 and a length of the wiring tray 40 is approximately equal to a length of the horizontal rod 20 so that the wiring tray 40 may cover the electric motor 31 and is disposed between each support assemblies 10. Two lateral sides of the rear wall 43 of the wiring tray 40 are separately protruded with a pivot 431. Each connecting rod 11 is formed with a pivot hole 111. The pivot 431 is rotatably received in the pivot hole 111 so that the wiring tray 40 may rotate between the two support assemblies 10. Also, two lateral sides of the front wall 42 are separately bent to form a fixing sheet 421. Each fixing sheet 421 is formed with a fixing hole 4211. The inside of each connecting rod 11 is formed with a threaded hole 112. The fixing hole 4211 may be passed by an adjusting screw D to connect with the threaded hole 112 to fix the wiring tray 40 as shown in FIG. 7. In addition, the wiring tray 40 may rotate around the two pivots 431 as an axis by loosening the adjusting screw D as shown in FIG. 8. Therefore, it is easy for the maintenance personnel to repair and organize wiring without removing whole wiring tray 40 in a narrow space.

Figure 9:
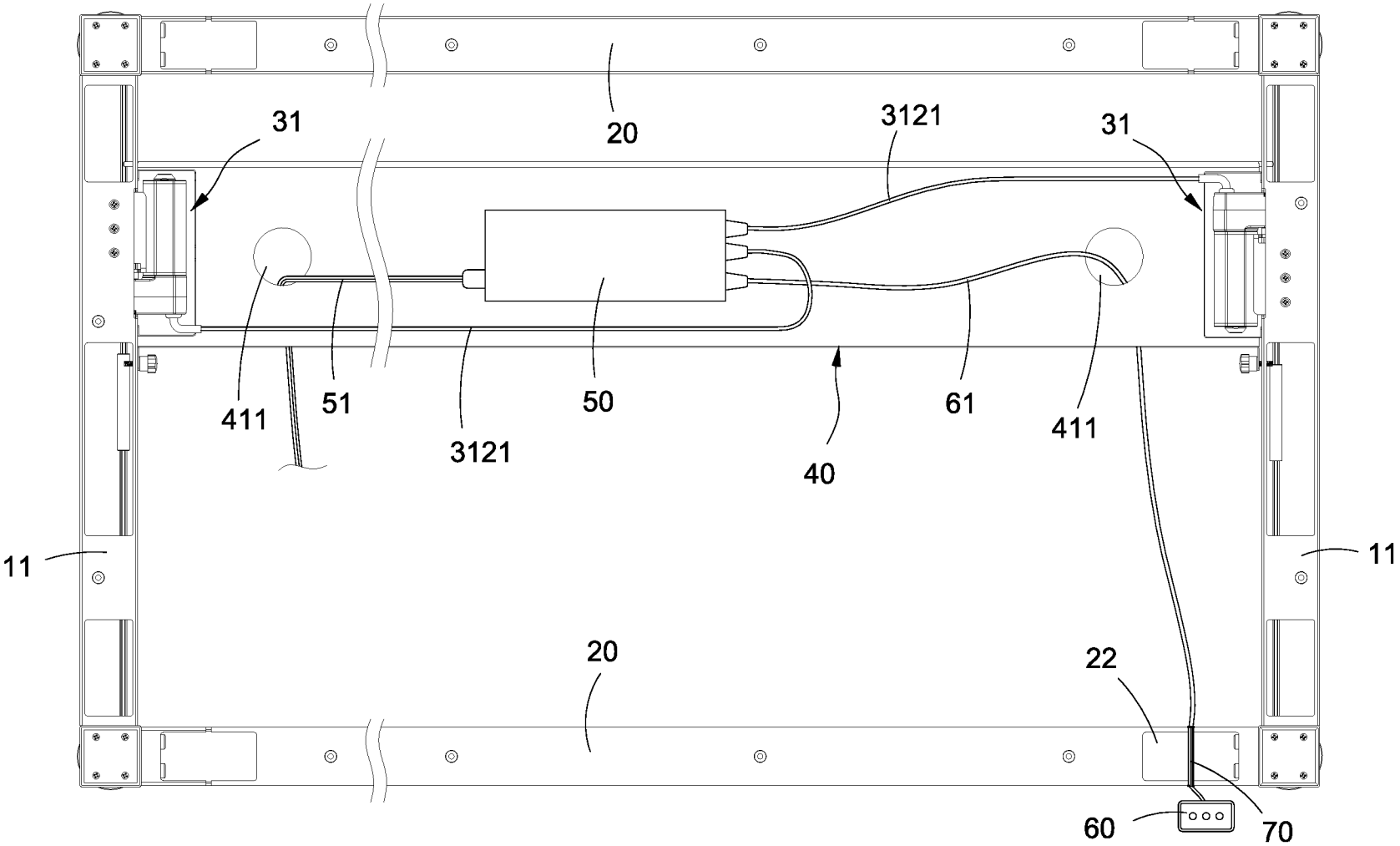
FIG. 9 is a schematic view of the wiring status of the wiring tray of the disclosure.

Furthermore, please refer to FIG. 9, the disclosure further includes a control box 50 and a hand controller 60. The control box 50 is placed in the wiring tray 40. The control box 50 is electrically connected to each main body 312 through two main body wires 3121. The control box 50 is further connected with a power cord 51 and a hand controller wire 61. The bottom 41 of the wiring tray 40 is formed with at least one wiring hole 411, through which the power cord may pass to connect to an external receptacle. The hand controller 60 is electrically connected to the control box 50 through the hand controller wire 61. The hand controller 60 may be operated to transmit signals to the control box 50 to control the main body 312. A notch 221 is respectively formed adjacent to the opening 22 of each horizontal rod 20. After the hand controller wire 61 passes through the wiring tray 40, it may further pass one of the notches 221 for the hand controller 60 to be hung on the horizontal rod 20. In some embodiments, the hand controller wire 61 is sheathed by a protective sleeve 70. The protective sleeve 70 covers a part of the hand controller wire 61 and is clamped in the notch 221 so that the hand controller wire 61 may be protected to avoid wearing or damaging when the hand controller wire 61 is being pulled.

While this disclosure has been described by means of specific embodiments, numerous modifications and variations could be made thereto by those skilled in the art without departing from the scope and spirit of this disclosure set forth in the claims.

What is claimed is:

1. A leg structure of an electric table, the leg structure comprising:

a pair of support assemblies (10), arranged spacedly and parallelly to each other, each support assembly (10) comprising a connecting rod (11) and a pair of telescopic posts (12), and each telescopic post (12) connected and fixed to the connecting rod (11);

multiple horizontal rods (20), separately connected to each support assembly (10), and parallel to each other; and a pair of drive assemblies (30), separately received in each support assembly (10) to drive each telescopic post (12) to ascend or descend;

a control box (50), comprising a power cord (51) and a hand controller wire (61), a hand controller (60), hung on the horizontal rod (20) and electrically connected with the control box (50) through the hand controller wire (61); and a protective sleeve (70), wherein each horizontal rod (20) comprises an opening (21) respectively disposed on two ends thereof, a notch (221) is disposed adjacent to each opening (22), and the protective sleeve (70) is clamped in at least one of the notch (211), wherein each telescopic post (12) comprises a locking block (121) protruded therefrom, a connecting portion (21) is respectively disposed on two ends of each horizontal rod (20), and each connecting portion (21) is inserted by each locking block (121), wherein a part of the hand controller wire (61) is covered by the protective sleeve (70).

2. The leg structure of claim 1, wherein the connecting rod (11) and each telescopic post (12) are connected by welding.

3. The leg structure of claim 1, wherein each telescopic post (12) is perpendicular to the connecting rod (11) to configure the support assembly (10) in a U-shape.

4. The leg structure of claim 1, further comprising multiple screwing elements (C), wherein each connecting portion (21) comprises multiple fixing holes (211), each locking block (121) comprises multiple threaded holes (1211), and each screwing element (C) passes through each fixing hole (211) to be screwed in each threaded hole (1211).

5. The leg structure of claim 1, further comprising a wiring tray (40), wherein the wiring tray (40) comprises a bottom (41), a front wall (42) and a rear wall (43), the front wall (42) and the rear wall (43) are disposed on two sides of the bottom (41), the rear wall (43) comprises a pivot (431) respectively protruded from two sides thereof, each connecting rod (11) comprises a pivot hole (111), and each pivot (431) is rotatably received in each pivot hole (111).

6. The leg structure of claim 5, further comprising two adjusting screws (D), wherein the front wall (42) comprises a fixing sheet (421) respectively disposed on two sides thereof, each fixing sheet (421) comprises a fixing hole (4211), each connecting rod (11) comprises a threaded hole (112), and each adjusting screw (D) passes through the fixing hole (4211) to be fastened with each threaded hole (112).

7. The leg structure of claim 1, wherein each drive assembly (30) comprises an electric motor (31) and two transmissions (32) disposed on two sides of the electric motor (31), each transmission (32) comprises a transmission shaft (321) connected to the electric motor (31), a first gear (322) connected to the transmission shaft (321), and a lead screw gear set (323), the lead screw gear set (323) comprises a second gear (3231) engaging with the first gear (322) and a lead screw (3232) connected to the second gear (3231), and the lead screw (3232) is fixed in the telescopic posts (12) correspondingly.

8. The leg structure of claim 7, wherein each drive assembly (30) further comprises a drive rod (33), one of the transmission shafts (321) in each drive assembly (30) passes through the electric motor (31), and an end of the transmission shaft (321) is sheathed by the drive rod (33) to be connected with another transmission shaft (321).

9. The leg structure of claim 7, wherein each electric motor (31) comprises a box (311) and a main body (312) disposed in the box (311).

10. The leg structure of claim 9, wherein each electric motor (31) further comprises a silencing pad (313) disposed between the main body (312) and the box (311).

11. The leg structure of claim 7, wherein each first gear (322) and each second gear (3231) comprise a slant worm gear.

12. The leg structure of claim 7, wherein each first gear (322) and each second gear (3231) comprise a plastic member.

* * * * *